US009671737B2

(12) United States Patent
Taniguchi

(10) Patent No.: US 9,671,737 B2
(45) Date of Patent: Jun. 6, 2017

(54) IMAGE FORMING APPARATUS

(71) Applicant: KYOCERA Document Solutions Inc., Osaka (JP)

(72) Inventor: Susumu Taniguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/090,960

(22) Filed: Apr. 5, 2016

(65) Prior Publication Data

US 2016/0291518 A1 Oct. 6, 2016

(30) Foreign Application Priority Data

Apr. 6, 2015 (JP) ..... 2015-077758

(51) Int. Cl.
*B65H 5/06* (2006.01)
*G03G 15/00* (2006.01)
(Continued)

(52) U.S. Cl.
CPC ..... *G03G 15/6529* (2013.01); *B65H 5/062* (2013.01); *G03G 21/1633* (2013.01); *G03G 21/1638* (2013.01); *B65H 2301/333* (2013.01); *B65H 2404/144* (2013.01); *B65H 2404/1521* (2013.01); *G03G 15/234* (2013.01); *G03G 2215/00544* (2013.01)

(58) Field of Classification Search
CPC ..... G03G 21/1633; G03G 21/1638; G03G 2215/00544; G03G 15/234; B65H 2404/144; B65H 2404/1521; B65H 2301/333
See application file for complete search history.

(56) References Cited

U.S. PATENT DOCUMENTS 7,784,786 B2 8/2010 Tashiro et al.
8,342,504 B2 * 1/2013 Yamamoto ..... B65H 1/04 271/127
(Continued)

FOREIGN PATENT DOCUMENTS

JP H11-079454 A 3/1999
JP 2003-137453 A 5/2003
(Continued)

OTHER PUBLICATIONS

An Office Action issued by the SIPO on Mar. 30, 2017, which corresponds to Chinese Patent Application No. 201610206168.7 and is related to U.S. Appl. No. 15/090,960; with English language translation.

*Primary Examiner* — Jeremy R Severson
(74) *Attorney, Agent, or Firm* — Studebaker & Brackett PC

(57) ABSTRACT

An image forming apparatus includes a casing, a conveyance unit, an intermediate roller unit, and a guide section. The intermediate roller unit includes an intermediate roller at a facing surface thereof that faces a sheet conveyance path. The conveyance unit includes a conveyance roller at a facing surface thereof that faces the sheet conveyance path. The guide section guides movement of the intermediate roller unit relative to the casing such that the conveyance roller pushes the intermediate roller in association with closing movement of the conveyance unit relative to the casing to close the intermediate roller unit relative to the casing.

16 Claims, 10 Drawing Sheets

(51) Int. Cl.
*G03G 21/16* (2006.01)
*G03G 15/23* (2006.01)

(56) References Cited

U.S. PATENT DOCUMENTS

| | | | | |
|---|---|---|---|---|
| 9,268,287 | B2 * | 2/2016 | Maruyama | G03G 15/6529 |
| 2007/0154238 | A1 * | 7/2007 | Yokoi | G03G 15/0194 399/124 |
| 2009/0121416 | A1 | 5/2009 | Tashiro et al. | |
| 2015/0239689 | A1 * | 8/2015 | Taniguchi | B65H 5/062 271/264 |

FOREIGN PATENT DOCUMENTS

| | | | |
|---|---|---|---|
| JP | 2008-044760 | A | 2/2008 |
| JP | 2009-211045 | A | 9/2009 |
| JP | 2011-201635 | A | 10/2011 |

* cited by examiner

IMAGE FORMING APPARATUS

INCORPORATION BY REFERENCE

The present application claims priority under 35 U.S.C. §119 to Japanese Patent Application No. 2015-077758, filed Apr. 6, 2015. The contents of this application are incorporated herein by reference in their entirety.

BACKGROUND

The present disclosure relates to an image forming apparatus that forms an image on a recording medium (for example, a sheet of paper).

An image forming apparatus includes a main body, a conveyance unit, and an intermediate roller unit. In association with closing movement of the conveyance unit relative to the main body, the intermediate roller unit is closed relative to the main body. When a conveyance guide of the conveyance unit pushes a conveyance guide of the intermediate roller unit in the image forming apparatus, the intermediate roller is closed relative to the main body.

SUMMARY

An image forming apparatus according to the present disclosure forms an image on a recording medium and includes a main body, an intermediate roller unit, a conveyance unit, and a guide section. The main body includes a first sheet conveyance path that conveys a recording medium and a second sheet conveyance path that conveys the recording medium disposed outward of the first sheet conveyance path. The intermediate roller unit is disposed between the first and second sheet conveyance paths in an openable and closable manner relative to the main body and has a facing surface that faces the first sheet conveyance path and that constitutes a part of a conveyance guide of the first sheet conveyance path and a facing surface that faces the second sheet conveyance path. The conveyance unit is disposed outward of the second sheet conveyance path in an openable and closable manner relative to the main body and has a facing surface that faces the second sheet conveyance path and that constitutes a part of a conveyance guide of the second sheet conveyance path. The guide section guides movement of the intermediate roller unit relative to the main body. The intermediate roller unit includes an intermediate roller disposed on the facing surface of the intermediate roller unit that faces the second sheet conveyance path. The intermediate roller conveys the recording medium to the second sheet conveyance path. The conveyance unit includes a conveyance roller disposed on the facing surface of the conveyance unit that faces the second sheet conveyance path. The conveyance roller forms a conveyance nip region with the intermediate roller. The guide section guide movement of the intermediate roller unit relative to the main body such that the conveyance roller pushes the intermediate roller in association with closing movement of the conveyance unit relative to the main body to close the intermediate roller unit relative to the main body.

DETAILED DESCRIPTION

Figure 1:
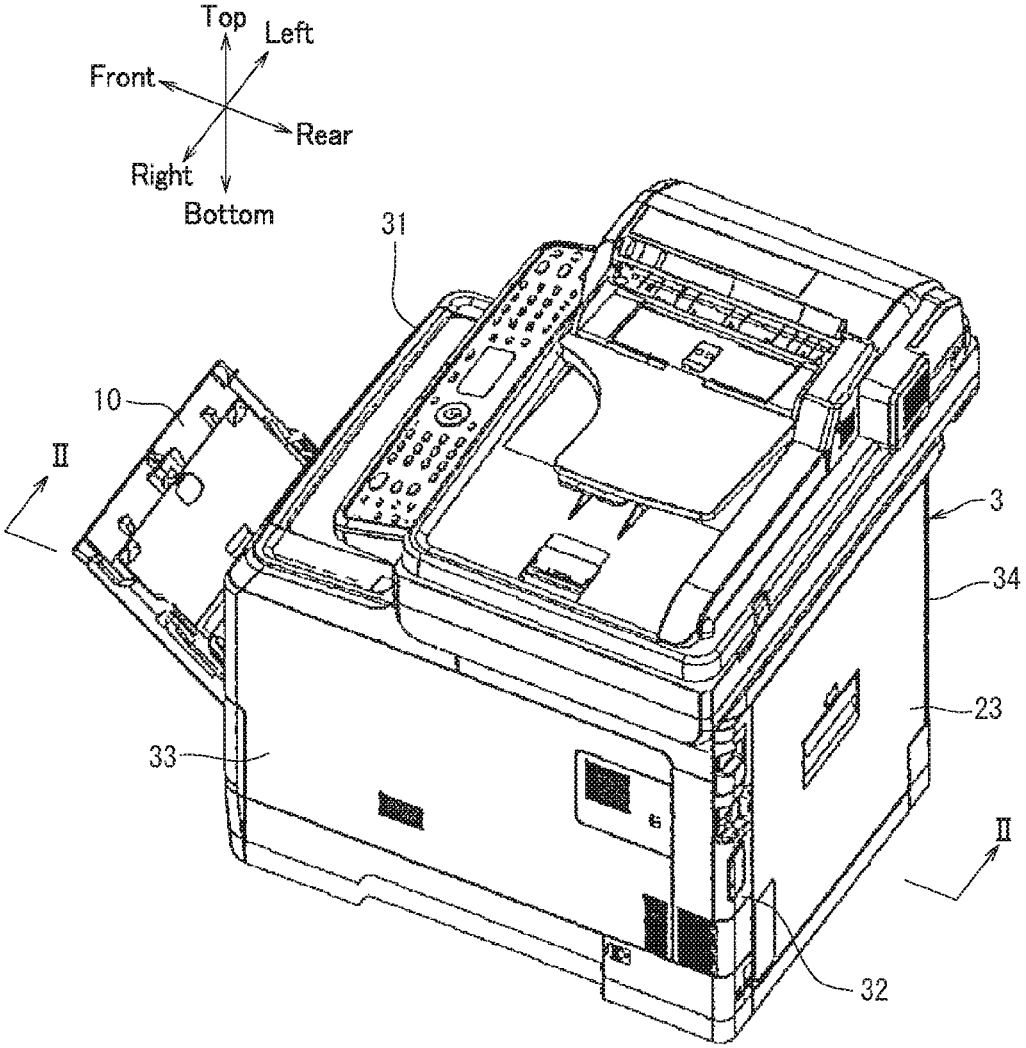
FIG. 1 is a perspective view illustrating an image forming apparatus according to an embodiment of the present disclosure.

Embodiments of the present disclosure will be described below with reference to the accompanying drawings. Note that elements that are the same or equivalent are indicated by the same reference signs in the drawings and description thereof is not repeated.

Configuration

Figure 2:
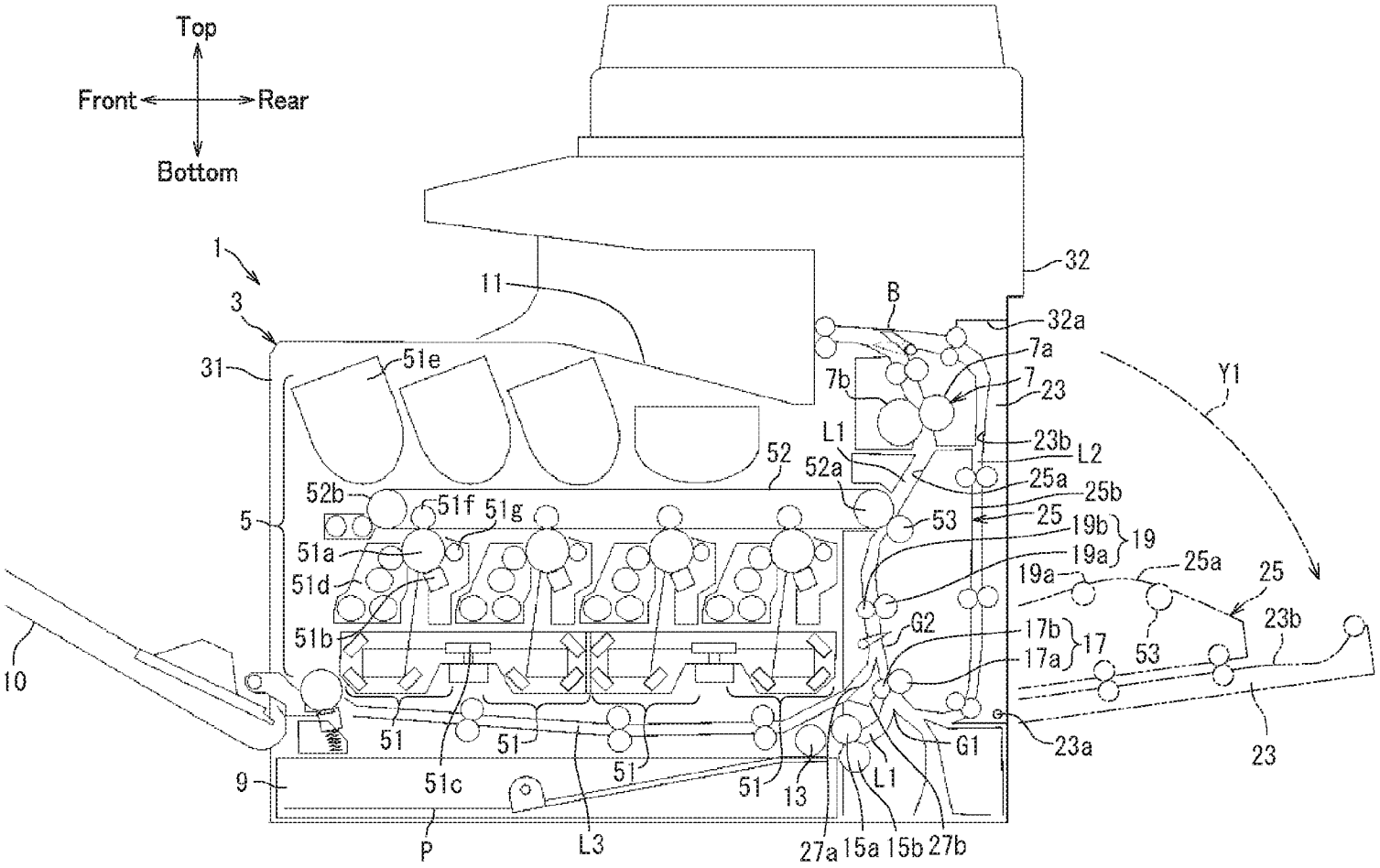
FIG. 2 is a cross sectional view taken along the line II-II in FIG. 1.
Figure 3:
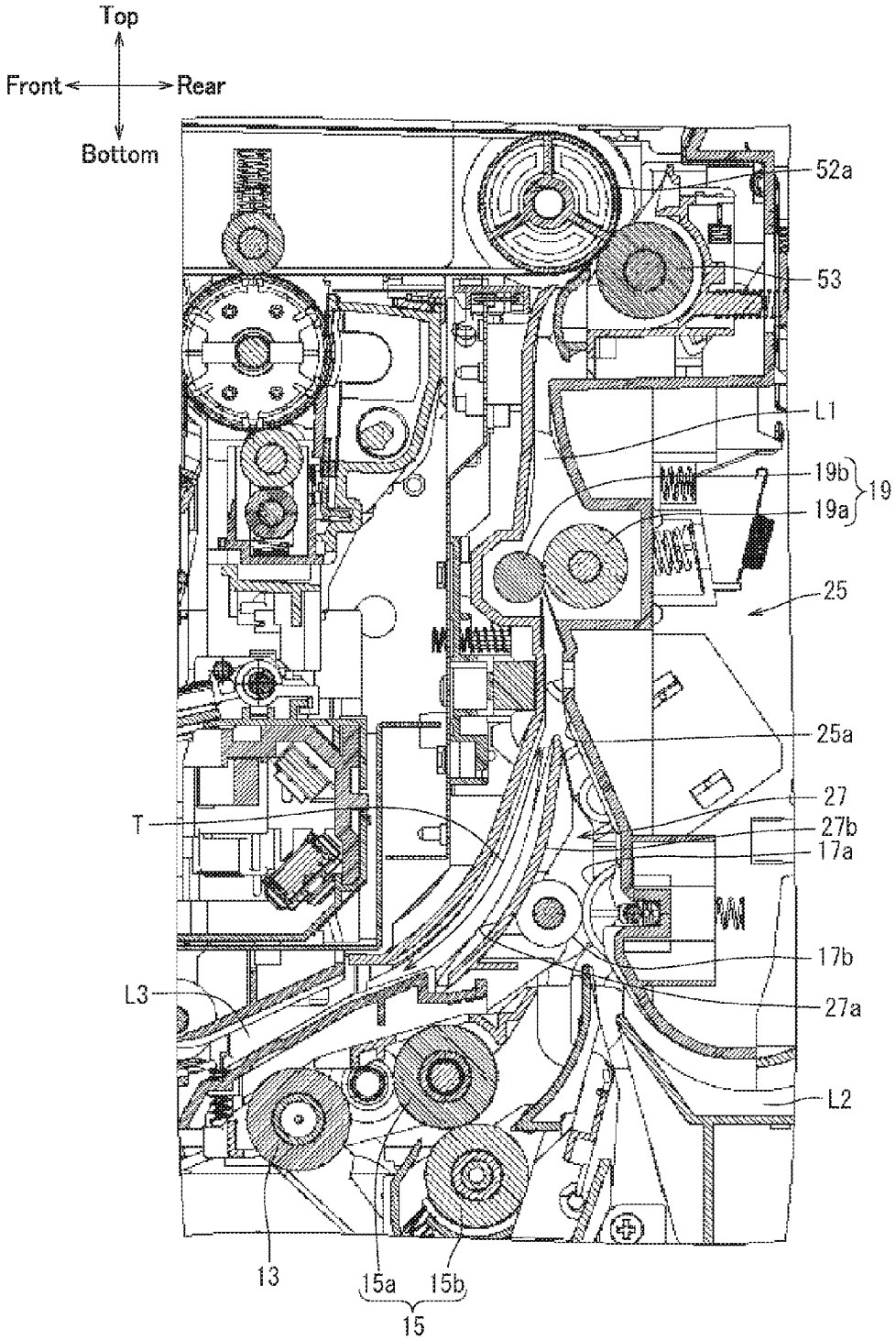
FIG. 3 is an enlarged cross sectional view of a main part in FIG. 2.

An image forming apparatus 1 according to an embodiment of the present disclosure will be described with reference to FIGS. 1 and 3. FIG. 1 is a perspective view of the image forming apparatus 1 according to an embodiment of the present disclosure. FIG. 2 is a cross sectional view taken along the line II-II in FIG. 1. FIG. 3 is an enlarged cross sectional view of a main part (a part around an intermediate roller unit 27) in FIG. 2.

As illustrated in FIGS. 1-3, the image forming apparatus 1 according to the present embodiment is an apparatus that forms an image on a sheet P and includes a casing (a main body) 3, an image forming section 5, a fixing section 7, a sheet feed cassette 9, a manual feed tray 10, and an exit tray 11. The sheet feed cassette 9 is disposed in a lower part of the casing 3. The image forming section 5 is disposed above the sheet feed cassette 9 in the casing 3. The exit tray 11 is disposed at the top of the casing 3 in an in-body space open at the sides thereof above the image forming section 5. The fixing section 7 is disposed beside the image forming section 5 in the casing 3.

The casing 3 has a box shape with a rectangular bottom surface and four side walls 31, 32, 33, and 34 that are surrounding walls. For the sake of description convenience, the side walls 31, 32, 33, and 34 are defined as follows in the present embodiment: the side wall 31 is a front wall; the side wall 32 opposite to the front wall is a rear wall; the side wall 33 is a right wall; and the side wall 34 is a left wall. Hereinafter, the side walls 31, 32, 33, and 34 may be referred to as the front wall 31, the rear wall 32, the right wall 33, and the left wall 34, respectively.

As illustrated in FIG. 1, the sides of the front wall 31, the rear wall 32, the right wall 33, and the left wall 34 are defined as the front, rear, right, and left sides of the image forming apparatus 1, respectively, in the present embodiment. In terms of the relationship between front, rear, right, and left sides defined as above, the fixing section 7 is disposed on the rear side of the image forming section 5.

The image forming section 5 forms a toner image on a sheet P fed from a sheet feed cassette 9 or a manual feed tray 10, as illustrated in FIG. 2. The image forming section 5 includes image forming units 51, an intermediate transfer belt 52, and a secondary transfer roller 53.

The intermediate transfer belt 52 is an endless belt. The intermediate transfer belt 52 is wound to be supported between a drive roller 52*a* and a driven roller 52*b* and is circulated by driving and rotation of the drive roller 52*a*.

The image forming units 51 correspond to toners in a plurality of colors (for example, cyan, magenta, yellow, and black). The image forming units 51 each form a toner image in a corresponding color on the surface of the intermediate transfer belt 52. The image forming units 51 each include a photosensitive drum 51*a*, a charger 51*b*, an exposure device 51*c*, a developing device 51*d*, a toner container 51*e*, a primary transfer roller 51*f*, and a cleaner 51*g*.

The photosensitive drum 51*a* includes a photosensitive layer on a surface thereof. The charger 51*b* uniformly charges the surface of the photosensitive drum 51*a* to a predetermined potential. The exposure device 51*c* irradiates the charged surface of the photosensitive drum 51*a* with laser light based on image information to form an electrostatic latent image corresponding to the image information on the surface of the photosensitive drum 51*a*. The toner container 51*e* supplies toner to the developing device 51*d*. The developing device 51*d* develops the electrostatic latent image formed on the surface of the photosensitive drum 51*a* to form a toner image.

The primary transfer roller 51*f* transfers the toner image on the surface of the photosensitive drum 51*a* to the surface of the intermediate transfer belt 52. The primary transfer roller 51*f* is supported such as to press the photosensitive drum 51*a* with the intermediate transfer belt 52 therebetween. Primary transfer voltage is applied to the surface of the primary transfer roller 51*f*. In the above configuration, when the toner image on the surface of the photosensitive drum 51*a* is pressed against the intermediate transfer belt 52, the toner image on the surface of the photosensitive drum 51*a* is transferred to the surface of the intermediate transfer belt 52 by electrostatic attraction of the primary transfer roller 51*f*. The cleaner 51*g* removes residual toner on the surface of the photosensitive drum 51*a* after transfer.

Through the above, the image forming units 51 for the respective colors form toner images in the respective colors on the surface of the intermediate transfer belt 52 so as to superpose the tone images. Thus, a color toner image is formed on the surface of the intermediate transfer belt 52. The color toner image is conveyed to the secondary transfer roller 53 by circulation of the intermediate transfer belt 52.

The secondary transfer roller 53 transfers the color toner image on the surface of the intermediate transfer belt 52 to the sheet P. The secondary transfer roller 53 is supported such as to press the drive roller 52*a* with the intermediate transfer belt 52 therebetween. Secondary transfer voltage is applied to the secondary transfer roller 53. With timing when the color toner image on the intermediate transfer belt 52 passes through a press contact region (a secondary transfer nip region) between the drive roller 52*a* and the secondary transfer roller 53, the sheet P passes through the press contact region between drive roller 52*a* and the secondary transfer roller 53. As a result, the color toner image on the intermediate transfer belt 52 is transferred to the sheet P by the secondary transfer voltage applied to the secondary transfer roller 53.

The fixing section 7 fixes the color toner image transferred to the sheet P. The fixing section 7 includes a pressure roller 7*a* and a fixing roller 7*b*. The fixing roller 7*b* includes a heat source to heat the sheet P. The pressure roller 7*a* is in press contact with the fixing roller 7*b*. The sheet P to which the color toner image is transferred passes through a press contact region (a fixing nip region) between the pressure roller 7*a* and the fixing roller 7*b*. As a result, the color toner image is fixed to the sheet P by heat of the fixing roller 7*b*. Through the above, an image is formed on the sheet P.

The sheet feed cassette 9 stores therein a plurality of sheets P. The sheets P in the sheet feed cassette 9 pass one at a time through a sheet conveyance path (a second sheet conveyance path) L1, the secondary transfer nip region between the drive roller 52*a* and the secondary transfer roller 53, and then the fixing nip region between the pressure roller 7*a* and the fixing roller 7*b*, and are finally ejected onto the exit tray 11.

The sheet conveyance path L1 extends upward from the sheet feed cassette 9 to the exit tray 11 along the rear wall 32 in the casing 3 via the secondary transfer nip region between the drive roller 52*a* and the secondary transfer roller 53 and the fixing nip region between the pressure roller 7*a* and the fixing roller 7*b*.

A pickup roller 13 is disposed in the vicinity of the sheet feed cassette 9 in the casing 3. A sheet feed roller pair 15, a conveyance roller pair 17, and a registration roller pair 19 are disposed in order from upstream to downstream in terms of a sheet conveyance direction in the sheet conveyance path L1. The sheet feed roller pair 15, the conveyance roller pair 17, and the registration roller pair 19 are disposed between the pickup roller 13 and the secondary transfer roller 53.

The pickup roller 13 picks up one at a time an uppermost sheet out of the sheets P in the sheet feed cassette 9. In a situation in which the pickup roller 13 picks up a plurality of sheets P, the sheet feed roller pair 15 feeds only the uppermost sheet P out of the plurality of sheets P to the conveyance roller pair 17 and returns the other sheet(s) P to the sheet feed cassette 9. The conveyance roller pair 17 conveys the sheet P fed from the sheet feed roller pair 15 to the registration roller pair 19. The registration roller pair 19 controls timing with which the sheet P from the conveyance roller pair 17 is fed to the secondary transfer nip region between the drive roller 52*a* and the secondary transfer roller 53.

The sheet feed roller pair 15 includes a sheet feed roller 15*a* and a retard roller 15*b*. The conveyance roller pair 17 includes a conveyance roller 17*a* and an intermediate roller 17*b*. The registration roller pair 19 includes a registration roller 19*a* and a registration driven roller 19*b*.

A reversed sheet conveyance path L2 in which the sheet P is turned over is located in the casing 3. As illustrated in FIG. 2, the reversed sheet conveyance path L2 branches off from the sheet conveyance path L1 at a branch point B, passes between the sheet conveyance path L1 and the rear wall 32, and merges with the sheet conveyance path L1 at a confluence point G1. The branch point B is located downstream of the fixing section 7 in the sheet conveyance path L1 in terms of the sheet conveyance direction. The confluence point G1 is located upstream of the conveyance roller pair 17 in the sheet conveyance path L1 in terms of the sheet conveyance direction. In a situation in which an image is to be formed on the back surface of the sheet P, the sheet P having passed through the fixing section 7 is drawn back to be conveyed into the reversed sheet conveyance path L2 through the branch point B, passes through the reversed sheet conveyance path L2, and is returned to the sheet conveyance path L1 from the confluence point G1. As a result, the sheet P is turned over. The reversed sheet P is conveyed in the sheet conveyance path L1. Then, an image is formed on the back surface of the sheet P in a similar manner to that described above.

The manual feed tray 10 feeds a sheet P to the image forming apparatus 1 in a manner different from the manner in which the sheet feed cassette 9 feeds the sheet P. The manual feed tray 10 protrudes outward from a side wall (for example, the front wall 31) of the casing 3. A manual sheet conveyance path (a first sheet conveyance path) L3 extends in the casing 3. The manual sheet conveyance path L3 connects the manual feed tray 10 to the sheet conveyance path L1. The manual sheet conveyance path L3 extends from the manual feed tray 10, passes between the image forming section 5 and the sheet feed cassette 9, and merges with the sheet conveyance path L1 at a confluence point G2 of the sheet conveyance path L1. In the configuration as above, the sheet conveyance path L1 is located behind (outward of) the manual sheet conveyance path L3. The confluence point G2 is located upstream of the registration roller pair 19 in the sheet conveyance path L1 in terms of the sheet conveyance direction. The sheet P having fed from the manual feed tray 10 is conveyed into the sheet conveyance path L1 from the confluence point G2 via the manual sheet conveyance path L3. The sheet P is then conveyed in the sheet conveyance path L1. Subsequently, an image is formed on the sheet P in a similar manner to that described above.

Figure 4:
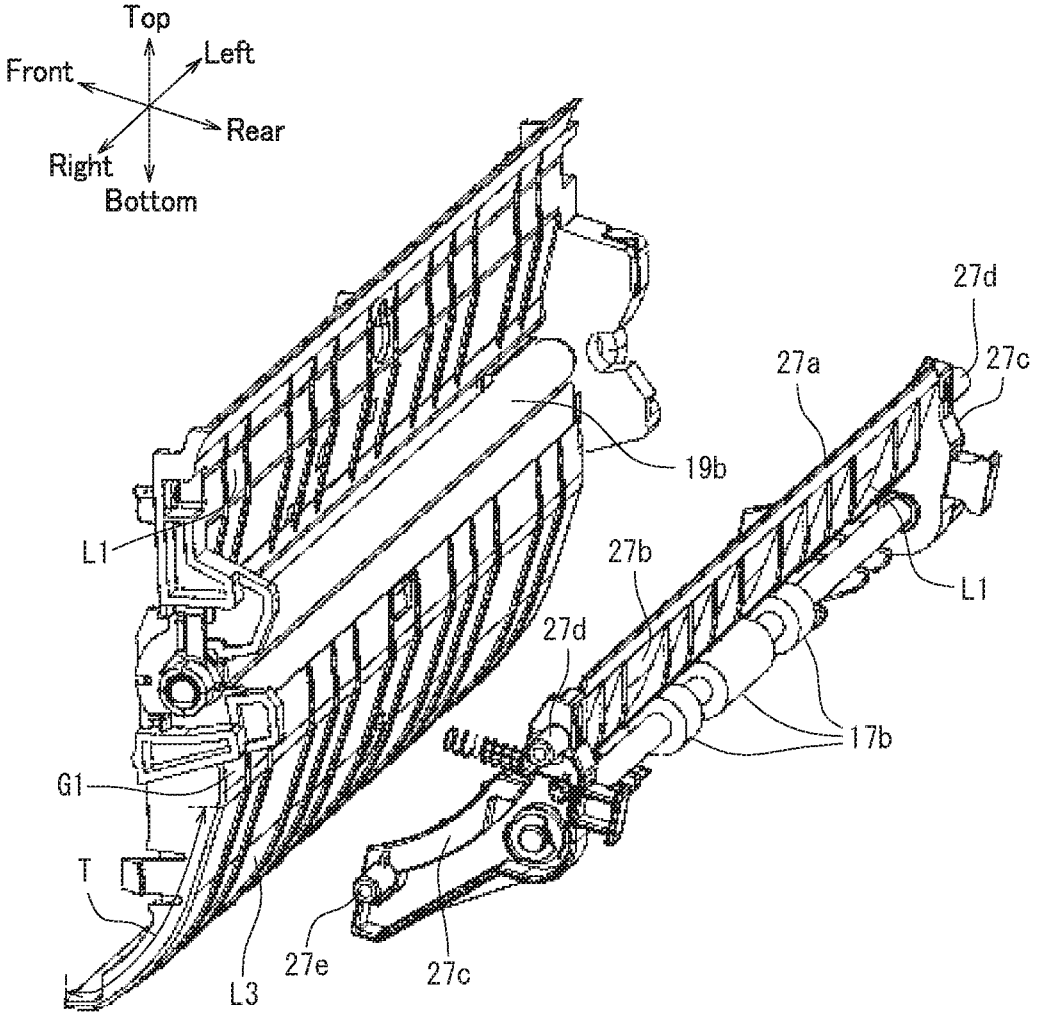
FIG. 4 is a perspective view illustrating a positional relationship between an intermediate roller unit in an open state and a manual sheet conveyance path.
Figure 5:
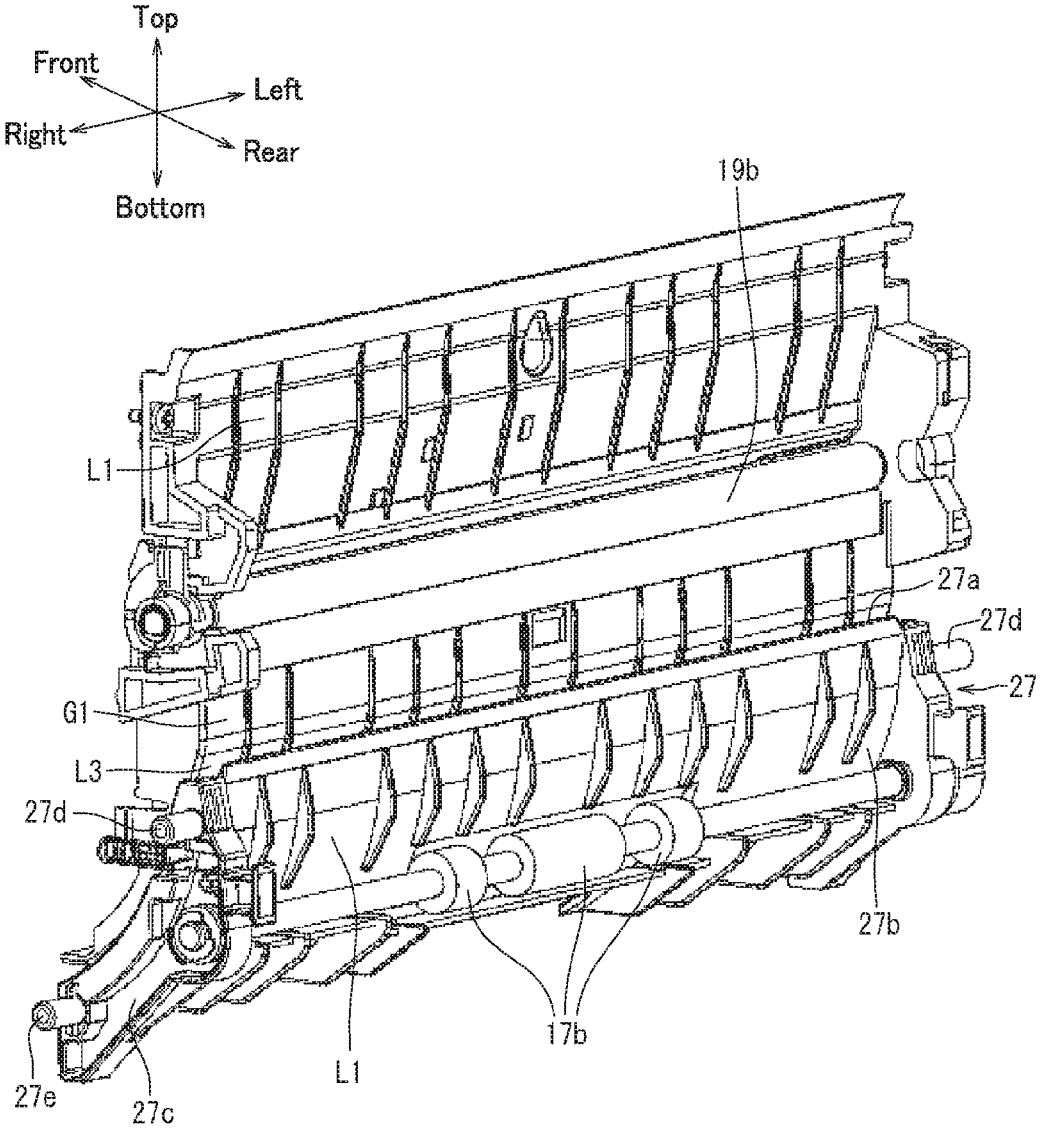
FIG. 5 is a perspective view illustrating a positional relationship between the intermediate roller unit in a closed state and the manual sheet conveyance path.
Figure 6:
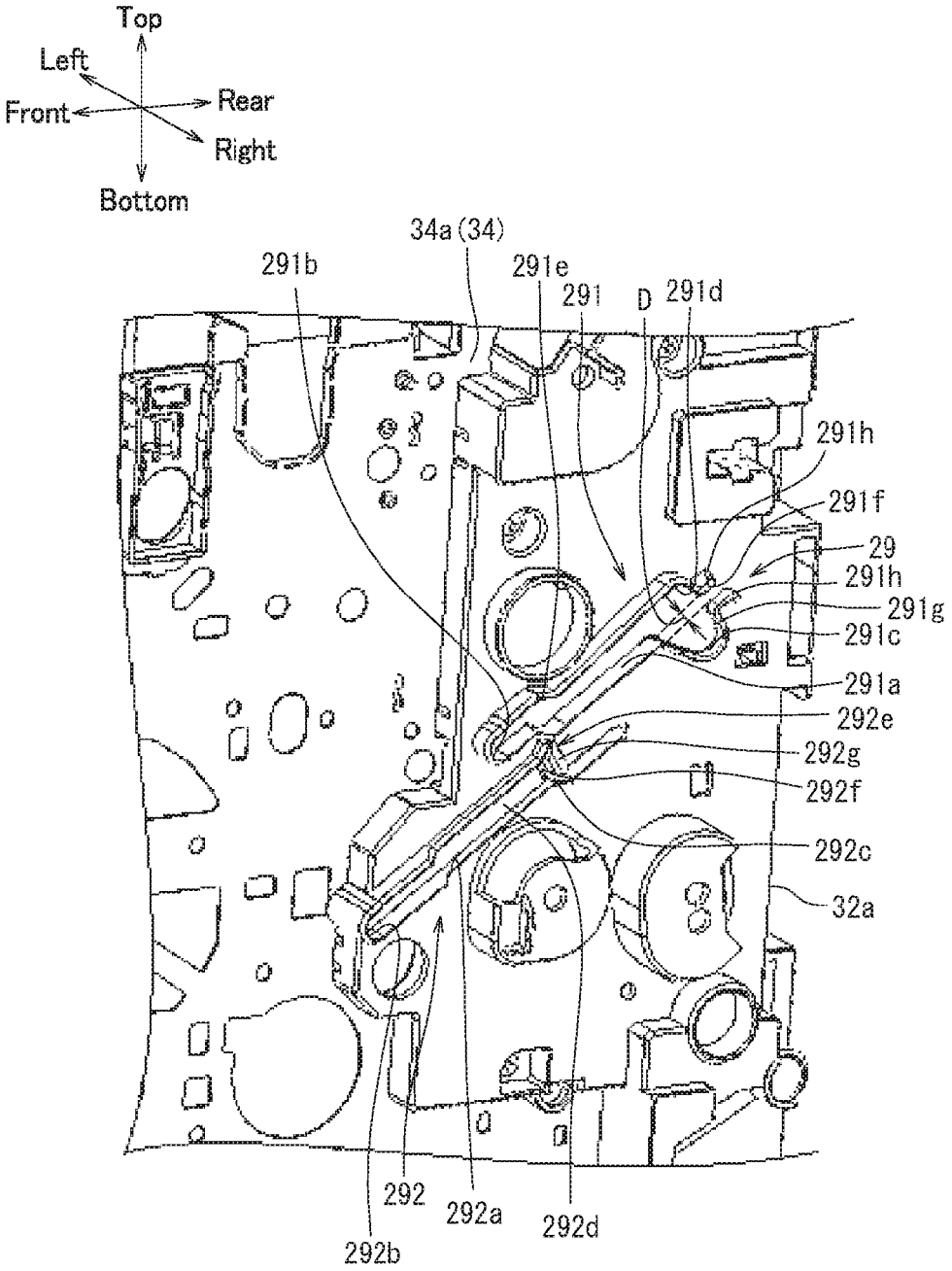
FIG. 6 is a perspective view illustrating a guide section disposed on a casing.

The image forming apparatus 1 further includes a cover 23, a conveyance unit 25, and an intermediate roller unit 27. The following describes the cover 23, the conveyance unit 25, and the intermediate roller unit 27 with reference to FIGS. 4-6 in addition to FIGS. 1-3. FIG. 4 is a perspective view illustrating a positional relationship between the intermediate roller unit 27 in an open state and the manual sheet conveyance path L3. FIG. 5 is a perspective view illustrating a positional relationship between the intermediate roller unit 27 in a closed state and the manual sheet conveyance path L3. FIG. 6 is a perspective view illustrating a guide section 29 disposed on the casing 3.

The cover 23 is disposed on one of the side walls (for example, the rear wall 32) of the casing 3 in an openable and closable manner, as illustrated in FIGS. 1 and 2. Specifically, the rear wall 32 has an opening 32*a*. The opening 32*a* is in a rectangular shape, for example. The opening 32*a* ranges in the rear wall 32 to cover the reversed sheet conveyance path L2. The cover 23 is disposed at the casing 3 so as to open and close the opening 32*a* of the rear wall 32. In an open state of the cover 23 opening the opening 32*a* of the rear wall 32, the interior of the casing 3 (for example, the fixing section 7 and the conveyance unit 25) is exposed. In a closed state of the cover 23 closing the opening 32*a* of the rear wall 32, the cover 23 closes the opening 32*a* to constitute a part of the rear wall 32.

As illustrated in FIG. 2, pivot shafts 23*a* are disposed on the respective opposite sides of a lower end part of the cover 23. The pivot shafts 23*a* are supported by the casing 3 in a rotatable manner. When an upper end part of the cover 23 is turned rearward (outward, in a direction indicated by an arrow Y1 in FIG. 2) about the pivot shafts 23*a* as pivots, the cover 23 is in the open state.

The cover 23 has an inner surface 23*b* that constitutes a part of a conveyance guide of the reversed sheet conveyance path L2. The inner surface 23*b* of the cover 23 faces the reversed sheet conveyance path L2 in the closed state of the cover 23 to function as the conveyance guide of the reversed sheet conveyance path L2.

The conveyance unit 25 is disposed between the sheet conveyance path L1 and the reversed sheet conveyance path L2, as illustrated in FIGS. 2 and 3. In the above configuration, the conveyance unit 25 is located behind (outward of) the sheet conveyance path L1. The conveyance unit 25 is disposed in an openable and closable manner relative to the casing 3. In the present embodiment, the conveyance unit 25 is disposed on the inner surface 23*b* of the cover 23 and is opened and closed relative to the casing 3 in association with opening and closing of the cover 23.

The conveyance unit 25 has facing surfaces 25*a* and 25*b*. The facing surface 25*a* faces a part of the sheet conveyance path L1. The facing surface 25*b* faces a part of the reversed sheet conveyance path L2. The facing surface 25*a* curves along the sheet conveyance path L1 to constitute a part of a conveyance guide of the sheet conveyance path L1. The conveyance roller 17*a*, the registration roller 19*a*, and the secondary transfer roller 53 are disposed on the facing surface 25*a*. The facing surface 25*b* constitutes a part of the conveyance guide of the reversed sheet conveyance path L2. The intermediate roller 17*b* that is a partner of the conveyance roller 17*a* of the conveyance roller pair 17 is disposed at the intermediate roller unit 27. The registration driven roller 19*b* that is a partner of the registration roller 19*a* of the registration roller pair 19 and the drive roller 52*a* that is a partner of the secondary transfer roller 53 are disposed at the casing 3.

The intermediate roller unit 27 is disposed between the sheet conveyance path L1 and the manual sheet conveyance path L3 so as to be openable and closable relative to the casing 3, as illustrated in FIGS. 2 and 3.

As illustrated in FIGS. 4 and 5, the intermediate roller unit 27 has a rectangular plate shape that is long in a left-right direction. The intermediate roller unit 27 has two main surfaces 27*a* and 27*b*. One 27*a* of the main surfaces 27*a* and 27*b* faces a part of the manual sheet conveyance path L3, and the other main surface 27*b* faces a part of the sheet conveyance path L1. Hereinafter, the main surfaces 27*a* and 27*b* are referred to as facing surfaces 27*a* and 27*b*, respectively. The facing surface 27*a* curves along the manual sheet conveyance path L3 to constitute a part of a conveyance guide of the manual sheet conveyance path L3. A segment T indicted in FIG. 3 is a segment of the manual sheet conveyance path L3 where the facing surface 27*a* constitutes the conveyance guide of the manual sheet conveyance path L3. The intermediate roller 17*b* is disposed on the facing surface 27*b*.

The intermediate roller unit 27 includes first bosses 27*d* and second bosses 27*e*. The first bosses 27*d* protrude from respective upper end parts in a longitudinal direction of opposite end surfaces 27*c* of the intermediate roller unit 27 in the left-right direction. The first bosses 27*d* may be cylindrical, for example. The second bosses 27*e* protrude from respective lower end parts in the longitudinal direction of the opposite end surfaces 27*c* of the intermediate roller unit 27. The second bosses 27*e* may be cylindrical, for example.

As illustrated in FIG. 6, the casing 3 include the guide section 29. The guide section 29 is disposed on the inner surface of each of the right and left side walls 33 and 34. That is, the guide sections 29 are located on the respective inner surfaces of the casing 3 that face the respective opposite end surfaces 27*c* of the intermediate roller unit 27. Note that FIG. 6 illustrates only a guide section 29 on an inner surface 34*a* of the left wall 34. The guide sections 29 guide opening and closing movement of the intermediate roller unit 27 relative to the casing 3. The guide sections 29 each include a first guide section 291 and a second guide section 292. The first guide section 291 guides movement of a corresponding one of the first bosses 27*d*. The second guide section 292 guides movement of a corresponding one of the second bosses 27*e*.

In the above configuration, the first and second guide sections 291 and 292 independently guide the movement of first and second bosses 27*d* and 27*e*, respectively. As a result, the intermediate roller unit 27 can be set in any posture during the first and second guide sections 291 and 292 guiding the movement of the intermediate roller unit 27.

Each of the first guide sections 291 is a guide rail having a guide groove 291*a*. The first guide section 291 allows the corresponding first boss 27*d* to move along the guide groove 291*a* to guide the movement of the first boss 27*d*. The first guide section 291 has opposite end portions, that is, an inward end portion (first inward end portion) 291*b* and an outward end portion (first outward end portion) 291*c*. The inward end portion 291*b* is located at an end on an "inward side" of the first guide section 291. The outward end portion 291*c* is located at an end on an "outward side" of the first guide section 291. The term "inward" herein means an inward location relative to the casing 3 within the casing 3. The term "outward" herein means an outward location relative to the casing 3 within the casing 3. In the present embodiment, the term "inward" corresponds to "front" and the term "outward" corresponds to "rear". The first bosses 27*d* are located at the respective inward end portions 291*b* in a closed state of the intermediate roller unit 27 and located at the respective outward end portions 291*c* in an open state thereof.

The outward end portion 291*c* of the first guide section 291 is located behind (outward of) and higher than the inward end portion 291*b*. The first guide section 291 has an apex portion 291*d*. The apex portion 291*d* is located between the inward and outward end portions 291*b* and 291*c*. The apex portion 291*d* is located higher than the inward and outward end portions 291*b* and 291*c* and closer to the outward end portion 291*c* than the center between the inward and outward end portions 291*b* and 291*c*. That is, a segment (a first segment) between the inward end portion 291*b* and the apex portion 291*d* of the first guide section 291 inclines rearwardly upward of the image forming apparatus 1 (that is, obliquely upward toward the conveyance unit 25). A segment (a second segment) between the apex portion 291*d* and the outward end portion 291*c* of the first guide section 291 inclines rearwardly downward of the image forming apparatus 1 (that is, obliquely downward toward the conveyance unit 25). These segments may each have a linear shape, for example. A stepped portion 291*e* is formed in the vicinity of the inward end portion 291*b* between the apex portion 291*d* and the inward end portion 291*b* so as to ascend in a stepwise fashion from the apex portion 291*d* toward the inward end portion 291*b*.

The inward and outward end portions 291*b* and 291*c* of the first guide section 291 are closed so as to prevent the first boss 27*d* from falling from the guide groove 291*a*. The first guide section 291 has an upper wall portion 291*g*. The upper wall portion 291*g* is located between the apex portion 291*d* and the outward end portion 291*c*. The upper wall portion 291*g* has an opening 291*f*. The upper wall portion 291*g* has two edge portions 291*h* opposite to each other. The opposite edge portions 291*h* define the opening 291*f*. The opposite edge portions 291*h* extend outward of the upper wall portion 291*g*. The opening 291*f* is located between two plate members that constitute the respective opposite edge portions 291*h* and disposed substantially in parallel to each other. The first boss 27*d* is put into and taken out from the guide groove 291*a* through the opening 291*f*. The opening 291*f* has an opening length D smaller (for example, slightly smaller) than the diameter of the first boss 27*d*. The opening length D (a distance between the opposite end portions) is a distance between the plate members that constitute the respective opposite edge portions 291*h*. When the first boss 27*d* is press fitted into the opening 291*f*, the first boss 27*d* is put into the guide groove 291*a*. When the first boss 27*d* is pulled out through the opening 291*f*, the first boss 27*d* is pulled out from the guide groove 291*a*. In the above configuration, a short path having the same width as the opening length D of the opening 291*f* is formed between the guide groove 291*a* and the opening 291*f*. In the above configuration, sufficient pressing force is needed to put the first boss 27*d* into and take out the first boss 27*d* from the guide groove 291*a* through the opening 291*f*. This can prevent the first boss 27*d* from falling from the opening 291*f*.

Each of the second guide sections 292 is a guide rail having a guide groove 292*a* likewise the first guide sections 291. The second guide section 292 has opposite end portions, that is, an inward end portion (second inward end portion) 292*b* and an outward end portion (second outward end portion) 292*c*. The inward end portion 292*b* is located at an end on an "inward side" of the second guide section 292. The outward end portion 292*c* is located at an end on an "outward side" of the second guide section 292. The term "inward" herein means an inward location relative to the casing 3 within the casing 3. The term "outward" herein means an outward location relative to the casing 3 within the casing 3. In the present embodiment, the term "inward" corresponds to "front" and the term "outward" corresponds to "rear". The second bosses 27*e* are located at the respective inward end portions 292*b* in the closed state of the intermediate roller unit 27 and located at the respective outward end portions 292*c* in the open state thereof. The outward end portion 292*c* is located behind (outward of) and higher than the inward end portion 292*b*. That is, a segment (a third segment) of the second guide section 292 between the inward and outward end portions 292*b* and 292*c* inclines rearwardly upward of the image forming apparatus 1 (that is, obliquely upward toward the conveyance unit 25).

The present embodiment describes an example in which the inward end portion 292*b* of the second guide section 292 is located frontward (inward of the casing 3) and below the inward end portion 291*b* of the first guide section 291. In the above configuration, the facing surface 27*a* of the intermediate roller unit 27 can be located along the segment T of the manual sheet conveyance path L3 in the closed state of the intermediate roller unit 27. Further, the outward end portion 292*c* of the second guide section 292 is located frontward (inward of the casing 3) and below the outward end portion 291*c* of the first guide section 291. In the above configuration, the intermediate roller unit 27 can be inclined so that the upper end part of thereof is located rearwardly upward of the image forming apparatus 1.

The segment of the second guide section 292 between the inward and outward end portions 292*b* and 292*c* may have a linear shape, for example. The upward angle of the second guide section 292 may be set to be equal to the inclined angle between the inward end portion 291*b* and the apex portion 291*d* of the first guide section 291, for example.

The inward end portion 292*b* of the second guide section 292 is closed, and the outward end portion 292*c* thereof is open. The second guide section 292 has an engaging protrusion 292*e*. The engaging protrusion 292*e* is disposed on a bottom surface 292*d* of the guide groove 292*a* of the second guide section 292 to close the open outward end portion 292*c*. The engaging protrusion 292*e* is capable of protruding from and being flush with the bottom surface 292*d*. The engaging protrusion 292*e* is returned to protrude from the bottom surface 292*d* by an urging member (not illustrated).

The engaging protrusion 292*e* has an inward surface 292*f* perpendicular to the bottom surface 292*d* of the guide groove 292*a*. An outward surface 292*g* of the engaging protrusion 292*e* inclines toward the inward surface 292*f* such that a top end of the engaging protrusion 292*e* is closer to the inward surface 292*f* than a base end thereof on the outward surface 292*g*. In the above configuration, when the second boss 27*e* pushes the outward surface 292*g* of the engaging protrusion 292*e*, the engaging protrusion 292*e* is flushed with the bottom surface 292*d*. Once the second boss 27*e* is put into the second guide section 292, the engaging protrusion 292*e* resiliently return to protrude from the bottom surface 292*d*. Even when the second boss 27*e* pushes the inward surface 292*f* of the engaging protrusion 292*e*, the engaging protrusion 292*e* is not flush with the bottom surface 292*d*. In the above configuration, the second boss 27*e* can be prevented from falling out from the second guide section 292.

The guide sections 29 on the respective inner surfaces of the right and left side walls 33 and 34 are in mirror symmetry.

The right and left first bosses 27*d* are fitted in the respective guide grooves 291*a* of the first guide sections 291 of the right and left side walls 33 and 34, while the right and left second bosses 27*e* are fitted in the respective guide grooves 292*a* of the second guide sections 292 on the right and left side walls 33 and 34. In the above configuration, the intermediate roller unit 27 is openable and closable relative to the casing 3.

Movement

Figure 7:
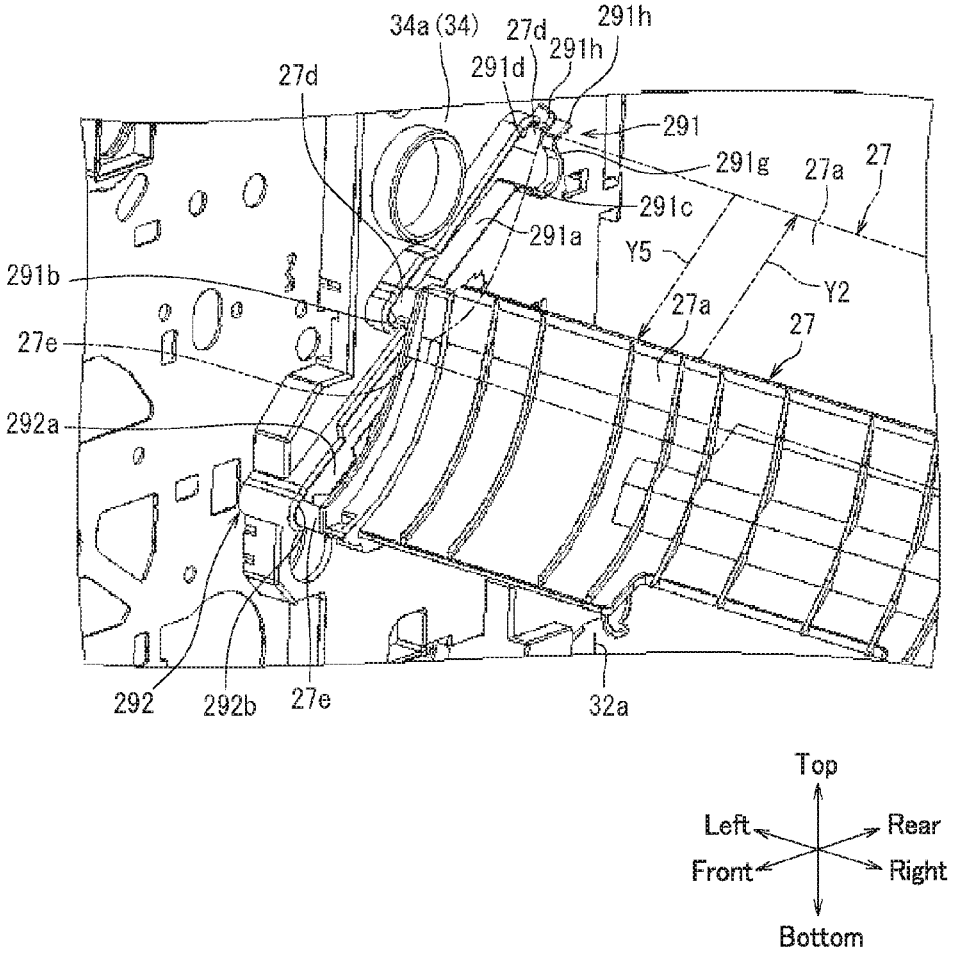
FIG. 7 is a perspective view illustrating a positional relationship between the intermediate roller unit in the closed state and the guide section.
Figure 8:
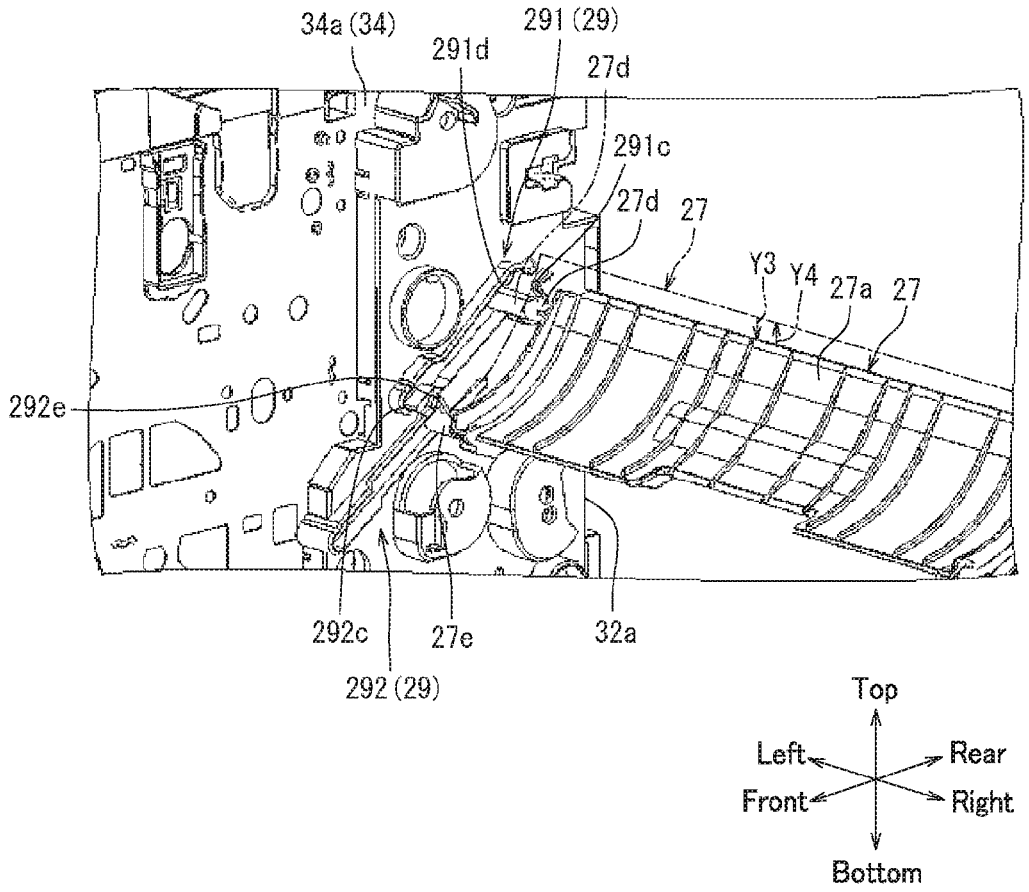
FIG. 8 is a perspective view illustrating a positional relationship between the intermediate roller unit in the open state and the guide section.
Figure 9:
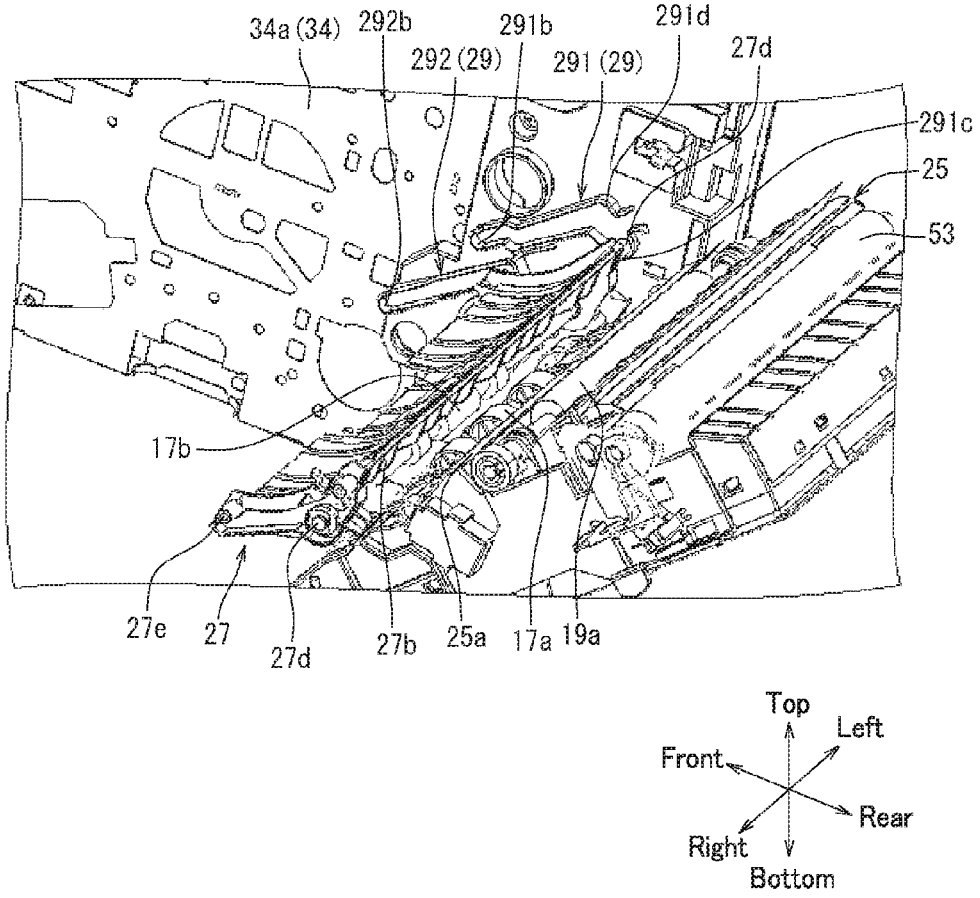
FIG. 9 is a perspective view illustrating a state in which a conveyance roller is in contact with an intermediate roller in closing movement of the conveyance unit.
Figure 10:
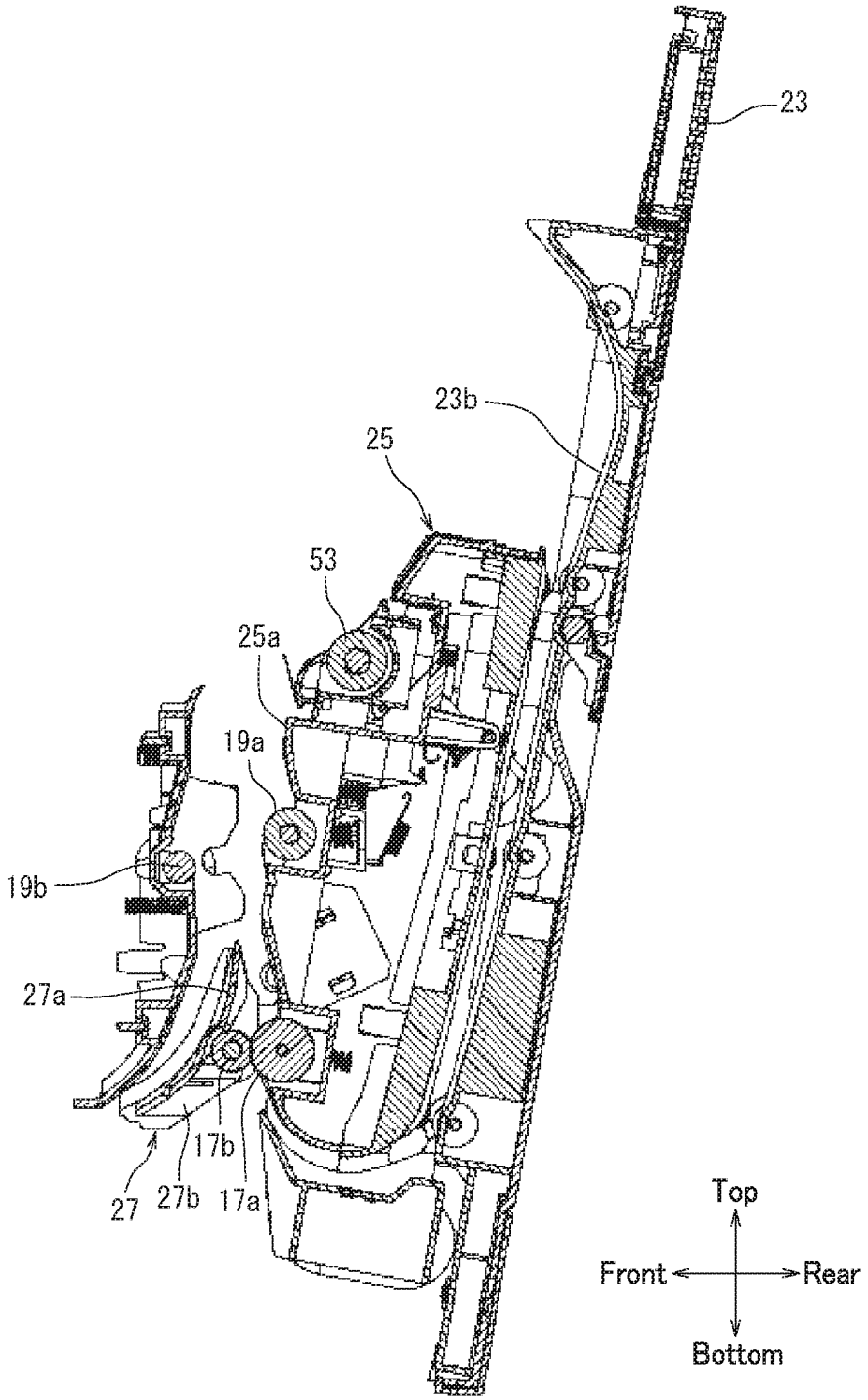
FIG. 10 is a cross sectional view illustrating a state in which the conveyance roller is in contact with the intermediate roller in closing movement of the conveyance unit.

Following describes with reference to FIGS. 3-10, opening and closing movement of the intermediate roller unit 27 relative to the casing 3. FIG. 7 is a perspective view illustrating a positional relationship between the intermediate roller unit 27 in the closed state and the guide section 29. FIG. 8 is a perspective view illustrating a positional relationship between the intermediate roller unit 27 in the open state and the guide section 29. FIG. 9 is a perspective view illustrating a state in which the conveyance roller 17*a* is in contact with the intermediate roller 17*b* in closing movement of the conveyance unit 25. FIG. 10 is a cross sectional view illustrating a state in which the conveyance roller 17*a* is in contact with the intermediate roller 17*b* in the closing movement of the conveyance unit 25.

In a state in which the intermediate roller unit 27 is closed relative to the casing 3 as illustrated in FIGS. 3 and 5, the first bosses 27*d* of the intermediate roller unit 27 are located at the respective inward end portions 291*b* of the first guide sections 291 while the second bosses 27*e* of the intermediate roller unit 27 are located at the respective inward end portions 292*b* of the second guide sections 292, as illustrated in FIG. 7. In the above state, as illustrated in FIGS. 3 and 5, the facing surface 27*a* of the intermediate roller unit 27 faces the manual sheet conveyance path L3 to function as the conveyance guide of the manual sheet conveyance path L3.

In order to open the intermediate roller unit 27 in the closed state (a state in which the intermediate roller unit 27 is closed relative to the casing 3) relative to the casing 3, the conveyance unit 25 is manually opened relative to the casing 3 first in a direction indicated by an arrow Y1 in FIG. 2. Subsequently, the intermediate roller unit 27 is manually pulled rearwardly upward from the casing 3 in a direction indicated by Y2 in FIG. 7. As a result, the respective first bosses 27*d* are slightly moved from the inward end portions 291*b* toward the apex portions 291*d* along the first guide sections 291, slightly moved rearward (outward) in the stepped portions 291*e*, and then moved to the apex portions 291*d*. In association therewith, the respective second bosses 27*e* are moved from the inward end portions 292*b* toward the outward end portions 292*c* along the second guide sections 292. Through the above, the intermediate roller unit 27 in the closed state is guided by the first and second guide sections 291 and 292 to be pulled rearwardly upward of the image forming apparatus 1 to the level of the apex portions 291*d*.

In the above movement, the first bosses 27*d* are slightly moved rearward (outward) in the respective stepped portions 291*e*. As a result, the facing surface 27*a* of the intermediate roller unit 27 is slightly separate from the manual sheet conveyance path L3. This can facilitate rearwardly upward pulling of the intermediate roller unit 27 relative to the image forming apparatus 1.

Subsequently, the upper end of the intermediate roller unit 27 is manually pulled rearwardly downward in a direction indicated by an arrow Y3 in FIG. 8. As a result, the respective first bosses 27*d* are moved from the apex portions 291*d* to the outward end portions 291*c* along the first guide sections 291. As a result, the intermediate roller unit 27 is greatly inclined rearward (outward) such as to be prevented from slipping off into the closed state by its own weight. Through the above, the intermediate roller unit 27 is opened relative to the casing 3.

In the open state, as illustrated in FIG. 4, the facing surface 27*a* of the intermediate roller unit 27 is separate from the segment T of the manual sheet conveyance path L3 such that the interior of the segment T of the manual sheet conveyance path L3 is exposed. In the above configuration, a jam (a jammed sheet P) in the exposed interior (the segment T) of the manual sheet conveyance path L3 can be removed easily.

After being pulled up to the apex portions 291*d*, the intermediate roller unit 27 is greatly inclined rearward (outward). As a result, a situation in which the intermediate roller unit 27 blocks an operator's view can be prevented when the operator checks the exposed interior (the segment T) of the manual sheet conveyance path L3.

In order to close the intermediate roller unit 27 relative to the casing 3, the conveyance unit 25 is manually closed relative the casing 3. That is, the cover 23 is manually closed relative to the casing 3. In association with the manual closing, as illustrated in FIGS. 9 and 10, the conveyance roller 17*a* of the conveyance unit 25 comes in contact with the intermediate roller 17*b* of the intermediate roller unit 27 to push and move the intermediate roller 17*b* inward of the casing 3. Hereinafter, a series of movement of the intermediate roller unit 27 in manual closing is referred to as closing movement. In the closing movement, the respective first bosses 27*d* of the intermediate roller unit 27 are moved from the outward end portions 291*c* to the apex portions 291*d* along the respective first guide sections 291 in the direction indicated by an arrow Y4 in FIG. 8. As a result, the intermediate roller unit 27 relatively stands upright.

When the manual closing is further continued, the respective first bosses 27*d* are moved from the apex portions 291*d* to the inward end portions 291*b* along the respective first guide sections 291 in the direction indicated by an arrow Y5 in FIG. 7. In association therewith, the respective second bosses 27*e* are moved from the outward end portions 292*c* to the inward end portions 292*b* along the respective second guide sections 292. As a result, as illustrated in FIG. 3, the intermediate roller unit 27 is closed relative to the casing 3. Through the above, the intermediate roller unit 27 is closed relative to the casing 3 in association with the closing movement of the conveyance unit 25 relative to the casing 3.

In the closed state, the conveyance roller 17*a* presses the intermediate roller 17*b*. In the above configuration, the facing surface 27*a* of the intermediate roller unit 27 is located opposite to the manual sheet conveyance path L3 to function as the conveyance guide of the manual sheet conveyance path L3 and to form the conveyance nip region between the conveyance roller 17*a* and the intermediate roller 17*b*.

In the closing movement, only the conveyance roller 17*a* among respective components of the conveyance unit 25 comes in contact with the intermediate roller 17*b* and the other components are out of contact with the intermediate roller unit 27. In the above configuration, a situation in which respective resin portions (for example, the conveyance guides) of the conveyance unit 25 and the intermediate roller unit 27 rub to generate sound or are broken can be prevented in the closing movement of the intermediate roller unit 27 relative to the casing 3.

The embodiment of the present disclosure has been described so far with reference to the drawings (FIGS. 1-10). However, the present disclosure is not limited to the above embodiment and a wide range of alterations can be made to the embodiment so long as such alterations do not deviate from the intended scope of the present disclosure (for example, (1) below). The drawings are schematic illustrations that emphasize elements of configuration in order to facilitate understanding thereof. Therefore, thickness, length, the number, etc. of each of the elements in the drawings may differ from actual ones of the elements for the sake of illustration convenience. Further, the properties of each of the elements, such as material, shape, and dimension thereof described in the above embodiment are mere examples and not limited specifically. The properties of the elements can be modified in various manners within the scope not substantially departing from the advantages of the present disclosure.

(1) In the present embodiment, the shape, length, and inclined angle of the segment between the inward end portion 291*b* and the apex portion 291*d* of each of first guide sections 291 are not limited specifically so long as only the conveyance roller 17*a* among the respective components of the conveyance unit 25 comes in contact with the intermediate roller 17*b* and the other components are out of contact with the intermediate roller unit 27 during the closing movement. The shape, length, and inclined angle of the segment between the apex portion 291*d* and the outward end portion 291*c* of each of the first guide section 291 are also not limited specifically. The same is applied to the shape, length, and inclined angle of the segment between the inward end portion 292*b* and the outward end portion 292*c* of each of the second guide sections 292.

What is claimed is:

1. An image forming apparatus that forms an image on a recording medium, comprising:

a main body including a first sheet conveyance path that conveys a recording medium and a second sheet conveyance path that conveys the recording medium, the second sheet conveyance path being disposed outward of the first sheet conveyance path;

an intermediate roller unit disposed between the first and second sheet conveyance paths in an openable and closable manner relative to the main body and having a facing surface that faces the first sheet conveyance path and that constitutes a part of a conveyance guide of the first sheet conveyance path and a facing surface that faces the second sheet conveyance path;

a conveyance unit disposed outward of the second sheet conveyance path in an openable and closable manner relative to the main body and having a facing surface that faces the second sheet conveyance path and that constitutes a part of a conveyance guide of the second sheet conveyance path; and a guide section configured to guide movement of the intermediate roller unit relative to the main body, wherein the intermediate roller unit includes an intermediate roller disposed on the facing surface of the intermediate roller unit that faces the second sheet conveyance path, the intermediate roller being configured to convey the recording medium to the second sheet conveyance path, the conveyance unit includes a conveyance roller disposed on the facing surface of the conveyance unit that faces the second sheet conveyance path, the conveyance roller forming a conveyance nip region with the intermediate roller, the guide section guides movement of the intermediate roller unit relative to the main body such that the conveyance roller pushes the intermediate roller in association with closing movement of the conveyance unit relative to the main body to close the intermediate roller unit relative to the main body, the intermediate roller unit includes first bosses that protrude from respective upper end parts of opposite end surfaces of the intermediate roller unit in a direction perpendicular to a sheet conveyance direction and second bosses that protrude from respective lower end parts of the opposite end surfaces thereof, and the guide section includes first guide sections and second guide sections at respective opposite inner surfaces of the main body that face the respective opposite end surfaces of the intermediate roller unit, the first guide sections guiding movement of the respective first bosses, the second guide sections guiding movement of the respective second bosses, the first guide sections each include:

a first inward end portion, a corresponding one of the first bosses being located at the first inward end portion in a closed state of the intermediate roller unit;

a first outward end portion located outward of and higher than the first inward end portion, a corresponding one of the first bosses being located at the first outward end portion in an open state of the intermediate roller unit; and an apex portion located between the first inward end portion and the first outward end portion and higher than the first inward end portion and the first outward end portion, and the second guide section each include:

a second inward end portion, a corresponding one of the second bosses being located at the second inward end portion in the closed state of the intermediate roller unit; and a second outward end portion located outward of the second inward end portion, a corresponding one of the second bosses being located at the second outward end portion in the open state of the intermediate roller unit.

2. The image forming apparatus according to claim 1, wherein the first guide section includes a stepped portion ascending from the apex portion toward the first inward end portion in a stepwise fashion, the stepped portion being located in the vicinity of the first inward end portion between the apex portion and the inward end portion.

3. The image forming apparatus according to claim 1, wherein the first guide sections each are a guide rail having a guide groove to guide movement of the first boss, and the first guide sections each have an upper wall portion between the apex portion and the first outward end portion, the upper wall portion having an opening, the upper wall portion having edge portions located opposite to each other and defining the opening, a distance between the edge portions is smaller than a diameter of the first bosses.

4. The image forming apparatus according to claim 3, wherein the edge portions of the upper wall portion extend outward of the upper wall portion, the guide groove and the opening of the first guide section shape a path, and the path has a width substantially equal to the distance between the edge portions of the upper wall portion.

5. The image forming apparatus according to claim 1, wherein the second guide sections each are a guide rail having a guide groove to guide movement of the second boss, the second outward end portion of each of the second guide sections is open, an engaging protrusion configured to close the second outward end portion protrudes from a bottom surface of the guide groove of a corresponding one of the second guide sections, and the engaging protrusion is capable of protruding from and being flush with the bottom surface of the guide groove and spontaneously returning to protrude from the bottom surface of the guide groove.

6. The image forming apparatus according to claim 5, wherein the engaging protrusion has an inward surface and an outward surface, the inward surface is perpendicular to the bottom surface of the guide groove, and the outward surface inclines toward the inward surface such that a top end of the engaging protrusion is closer to the inward surface than a base end of the engaging protrusion on the outward surface.

7. The image forming apparatus according to claim 1, wherein the first guide sections each have a first segment between the first inward end portion and the apex portion and a second segment between the apex portion and the first outward end portion, the first segment inclining obliquely upward toward the conveyance unit, the second segment inclining obliquely downward toward the conveyance unit.

8. The image forming apparatus according to claim 7, wherein the first and second segments lie linearly.

9. The image forming apparatus according to claim 1, wherein the second guide sections each have a third segment between a corresponding one of the second inward end portions and a corresponding one of the second outward end portions of the second guide sections, the third segment inclining obliquely upward toward the conveyance unit.

10. The image forming apparatus according to claim 9, wherein the third segment lies linearly.

11. The image forming apparatus according to claim 1, wherein the second inward end portions of the respective second guide sections are located below and inward of the first inward end portions of the respective first guide sections in the main body.

12. The image forming apparatus according to claim 1, wherein the second outward end portions of the respective second guide sections are located below and inward of the first outward end portions of the respective first guide sections in the main body.

13. The image forming apparatus according to claim 1, wherein the second guide sections each have an upward angle that is a same as an inclined angle of a segment of each of the first guide sections between the first inward end portion and the apex portion.

14. An image forming apparatus that forms an image on a recording medium, comprising:

a main body including a first sheet conveyance path that conveys a recording medium, a second sheet conveyance path that conveys the recording medium, and a third sheet conveyance path that conveys the recording medium, the second sheet conveyance path being disposed outward of the first sheet conveyance path, the third sheet conveyance path being disposed inward of the first conveyance path;

an intermediate roller unit disposed between the first and second sheet conveyance paths in an openable and closable manner relative to the main body and having a facing surface that faces the first sheet conveyance path and that constitutes a part of a conveyance guide of the first sheet conveyance path and a facing surface that faces the second sheet conveyance path;

a conveyance unit disposed outward of the second sheet conveyance path in an openable and closable manner relative to the main body and having a facing surface that faces the second sheet conveyance path and that constitutes a part of a conveyance guide of the second sheet conveyance path; and a guide section configured to guide movement of the intermediate roller unit relative to the main body, wherein the intermediate roller unit includes an intermediate roller disposed on the facing surface of the intermediate roller unit that faces the second sheet conveyance path, the intermediate roller being configured to convey the recording medium to the second sheet conveyance path, the conveyance unit includes a conveyance roller disposed on the facing surface of the conveyance unit that faces the second sheet conveyance path, the conveyance roller forming a conveyance nip region with the intermediate roller, a surface of the intermediate roller unit that is opposite to the facing surface of the intermediate roller unit that faces the first sheet conveyance path constitutes a part of the third conveyance path, when the intermediate roller unit is open relative to the main body, the guide section guides movement of the intermediate roller unit relative to the main body and keeps the intermediate roller unit open relative to the main body such that the intermediate roller is opened outward relative to the main body separate from the third conveyance path, and the guide section guides movement of the intermediate roller unit relative to the main body such that the conveyance roller pushes the intermediate roller in association with closing movement of the conveyance unit relative to the main body to close the intermediate roller unit relative to the main body.

15. The image forming apparatus according to claim 14, further comprising an image forming section that forms an image on the recording medium, a paper feed cassette that accommodates the recording medium and supplies the recording medium to the image forming section, and a paper feed tray separate from the paper feed cassette that supplies another recording medium to the image forming section, wherein the recording medium is conveyed from the paper feed cassette to the image forming section through the first sheet conveyance path, the recording medium carrying an image formed thereon by the image forming section is reversed and re-conveyed to the image forming section in the second sheet conveyance path, and the other recording medium is conveyed from the paper tray to the image forming section through the third sheet conveyance path.

16. The image forming apparatus according to claim 14, wherein the intermediate roller unit is kept open relative to the main body by an own weight of the intermediate roller unit, and the conveyance roller pushes the intermediate roller in association with closing movement of the conveyance unit relative to the main body to close the intermediate roller unit relative to the main body by the own weight of the intermediate roller unit.

* * * * *